US009131783B2

(12) United States Patent
Chacon et al.

(10) Patent No.: US 9,131,783 B2
(45) Date of Patent: Sep. 15, 2015

(54) REMOVABLE CONTROL MECHANISM FOR USE IN UPHOLSTERED FURNITURE

(75) Inventors: Ryan Chacon, Carthage, MO (US); William Rohr, Joplin, MO (US)

(73) Assignee: L&P PROPERTY MANAGEMENT COMPANY, South Gate, CA (US)

( * ) Notice: Subject to any disclaimer, the term of this patent is extended or adjusted under 35 U.S.C. 154(b) by 810 days.

(21) Appl. No.: 13/285,663

(22) Filed: Oct. 31, 2011

(65) Prior Publication Data

US 2013/0106164 A1 May 2, 2013

(51) Int. Cl.

| | |
|---|---|
| ***A47C 7/62*** | (2006.01) |
| ***A47C 31/00*** | (2006.01) |
| ***A47C 7/72*** | (2006.01) |

(52) U.S. Cl.

CPC ..... *A47C 31/008* (2013.01); *A47C 7/72* (2013.01)

(58) Field of Classification Search

USPC ..... 297/68, 217.3, 330; 348/837; 345/173; 361/679.29, 679.41

See application file for complete search history.

(56) References Cited

U.S. PATENT DOCUMENTS

| | | | | |
|---|---|---|---|---|
| 6,731,088 | B2 * | 5/2004 | Nivet | 318/548 |
| 6,905,167 | B2 * | 6/2005 | Jost | 297/188.04 |
| 7,040,698 | B2 * | 5/2006 | Park et al. | 297/217.3 |
| 7,044,546 | B2 * | 5/2006 | Chang | 297/217.3 |
| 7,201,356 | B2 * | 4/2007 | Huang | 248/309.1 |
| 7,290,833 | B2 * | 11/2007 | Park et al. | 297/217.3 |
| 7,857,382 | B2 * | 12/2010 | Vitito | 297/217.3 |
| 8,203,657 | B2 * | 6/2012 | Vitito | 348/837 |
| 8,403,411 | B2 * | 3/2013 | Boyer et al. | 297/217.3 |
| 8,625,034 | B2 * | 1/2014 | Campbell et al. | 348/837 |
| 2008/0238159 | A1 * | 10/2008 | Parnis et al. | 297/180.12 |
| 2010/0060050 | A1 * | 3/2010 | Muirhead | 297/217.4 |
| 2011/0174926 | A1 * | 7/2011 | Margis et al. | 244/118.6 |
| 2011/0248533 | A1 * | 10/2011 | Henderson | 297/184.13 |
| 2012/0132746 | A1 * | 5/2012 | Sizelove | 244/118.6 |
| 2013/0313871 | A1 * | 11/2013 | Shalaby et al. | 297/217.2 |
| 2013/0341977 | A1 * | 12/2013 | Kiefer et al. | 297/217.3 |
| 2013/0342335 | A1 * | 12/2013 | McQueen et al. | 340/436 |

* cited by examiner

*Primary Examiner* — David R Dunn
*Assistant Examiner* — Alexander Harrison
(74) *Attorney, Agent, or Firm* — Shook, Hardy & Bacon L.L.P.

(57) ABSTRACT

A seating unit is provided with a detachable bezel that is selectively engaged and disengaged to a receiving module. The receiving module is assembled to an interior of the seating unit and operably coupled to the activation device (e.g., linear actuator for adjusting the position of the seating unit). In operation, the receiving module is configured to receive command signals via a communication interface between the receiving module and the detachable bezel. Typically, an intermediate material of the seating unit intersects the communication interface. Further, the receiving module is configured to invoke the activation device as a function of the command signals. The detachable bezel resides external to the seating unit and is freely wielded by a user upon being disengaged from the receiving module. Additionally, the detachable bezel includes touch-activated controls that, upon receiving user-initiated actuation, generate the command signals via the communication interface.

20 Claims, 4 Drawing Sheets

REMOVABLE CONTROL MECHANISM FOR USE IN UPHOLSTERED FURNITURE

CROSS-REFERENCE TO RELATED APPLICATIONS

None.

STATEMENT REGARDING FEDERALLY SPONSORED RESEARCH OR DEVELOPMENT

None.

BACKGROUND OF THE INVENTION

Modern seating units exist that allow a user to adjust a backrest relative to a seat and/or to extend a footrest relative to a chair base. These existing seating unit use mechanisms (e.g., electric motors or linear actuators) to control adjustment of an inclination angle of the backrest and the extension of the footrest. Typically, these mechanisms are housed internal to the seating unit such that the mechanisms are hidden from view. Further, these mechanisms require an external component that allows an operator (e.g., occupant of the seating unit) to interface with the mechanism and direct control of the mechanism. Typically, the external components are fixedly mounted to the seating unit, thus, precluding the operator from effecting control of the mechanism from a location removed from the seating unit or from a more relaxed position within the seating unit. Accordingly, embodiments of the present invention pertain to technology for allowing the operator to attach and detach the external component from the seating unit while allowing the external component control the mechanism for adjusting the seating unit when attached to the seating unit.

BRIEF SUMMARY OF THE INVENTION

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

The present invention relates broadly to motion upholstery furniture designed to support a user's body in an essentially seated disposition. Motion upholstery furniture includes recliners, incliners, sofas, love seats, sectionals, theater seating, traditional chairs, and chairs with a moveable seat portion, such furniture pieces being referred to herein generally as "seating units." More particularly, embodiments of the present invention are directed an improved removable control mechanism that controls a device for adjusting the seating unit.

This user improved interface includes two complimentary components: an external component (referred to herein as the "detachable bezel") that is handled by an operator when controlling the mechanism, and an internal component (referred to herein as the "receiving module") that is assembled to an interior of the seating unit and is electrically connected to the mechanism for adjusting the seating unit. These components are capable of interacting when engaged, but not when disengaged. When engaged, the detachable bezel is selectively mounted in proximity to the receiving module, where the selective mounting may be accomplished through the use of securing elements (e.g., magnets). When disengaged, the detachable bezel is freely wielded by the operator without any restrictions (e.g., cords) while, at the same time, ceases interactive communication with the receiving module.

In an exemplary embodiment, the detachable bezel exposes controls that are configured as a user interface for the operator to initiate automatic adjustment of the seating unit. When the detachable bezel is selectively mounted in proximity to the receiving module, user-initiated interaction with the controls on the detachable dazzle is detected and transmitted as command signals to the receiving module. In one instance, the receiving module passes these command signals directly to the mechanism (e.g., electric motor or linear actuator), where, upon receiving the command signal, the mechanism is invoked effectuate adjustment of the seating unit. In another instance, the command signals are passed to processing unit. Typically, the processing unit is responsible for interpreting the command signals and generating an output, based on predefined logic, that instructs the mechanism to controllably adjust the seating unit. In still other instances, the command signals received at the receiving module are relayed to one or more destination devices (e.g., stereo equipment, thermostat, lighting fixtures, and the like) that affect an environment surrounding an occupant of the seating unit.

BRIEF DESCRIPTION OF THE SEVERAL VIEWS OF THE DRAWING

In the accompanying drawings which form a part of the specification and which are to be read in conjunction therewith, and in which like reference numerals are used to indicate like parts in the various views.

DETAILED DESCRIPTION OF THE INVENTION

Generally, embodiments of the present invention introduce technology for enabling and disabling an operator's control of an activation device (e.g., electric motor or linear actuator), which is configured to automatically adjust a seating unit. This technology, in embodiments, include a receiving module and a detachable bezel.

Figure 1:
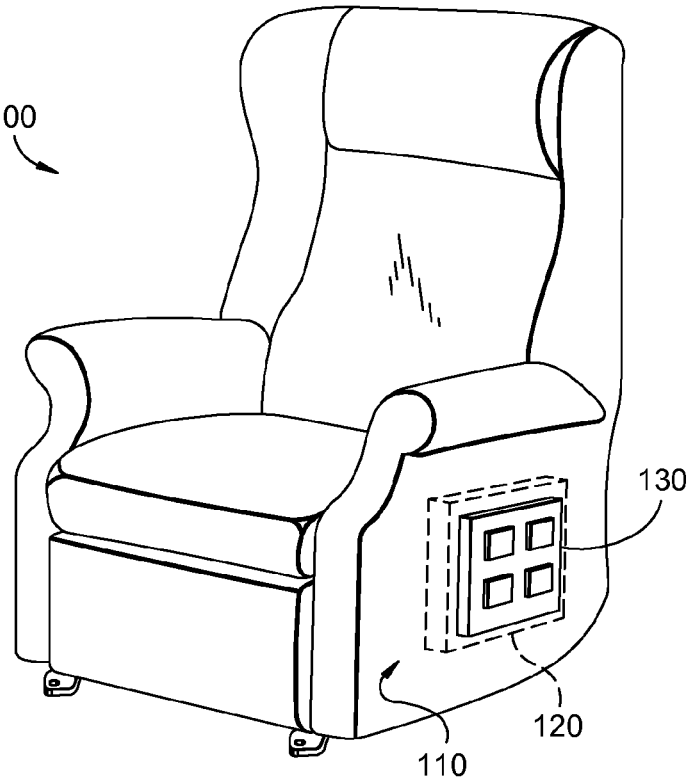
FIG. 1 is a diagrammatic perspective view of a seating unit with a detachable bezel illustrated as engaged to a receiving module that is hidden within an interior of the seating unit, in accordance with an embodiment of the present invention.

Turning to FIG. 1, a seating unit 100 is shown with the detachable bezel 130 engaged to the receiving module 120. The receiving module 120 is assembled to an interior of the seating unit 100 and operably coupled to the activation device (see reference 635 of FIG. 3). In operation, the receiving module 120 is configured to receive command signals via a communication interface and to invoke the activation device as a function of the command signals. The detachable bezel 130 resides external to the seating unit 100. Generally, the detachable bezel 130 includes touch-activated controls that, upon receiving user-initiated actuation, generate the command signals via the communication interface. Further, a portion 110 (e.g., a section of substrate, upholstery, or fabric used as an exterior cover) of the seating unit 100 intersects, at least in part, the communication interface that resides between the detachable bezel 130 in the receiving module 120.

Figure 2:
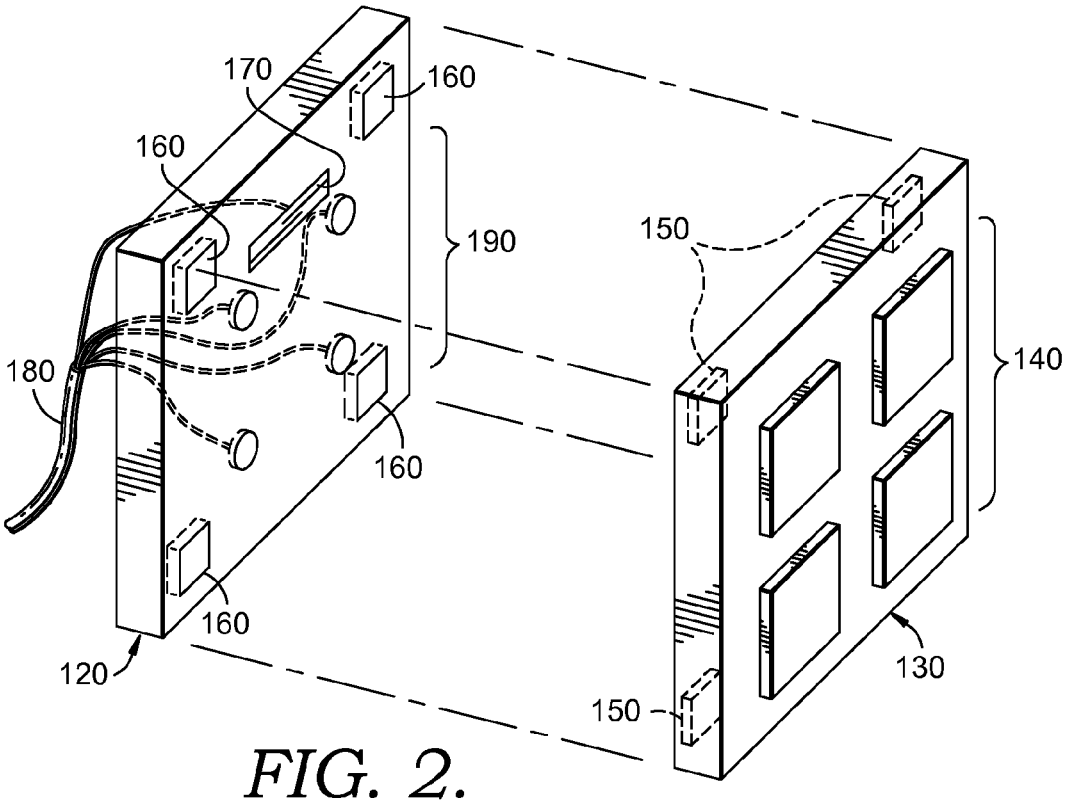
FIG. 2 is an exploded view of the detachable bezel and the receiving module depicting the securing elements for facilitating engagement, in accordance with an embodiment of the present invention.

Turning to FIG. 2, an exploded view of the detachable bezel 130 and the receiving module 120 is illustrated. In particular, FIG. 2 depicts the securing elements 150 and 160 for facilitating engagement between the detachable bezel 130 and the receiving module 120, respectively, in accordance with an embodiment of the present invention. These securing elements 150 and 160 are generally employed to attach the detachable bezel 130 to an exterior surface of the intermediate materials (e.g., bed sheets or section of upholstery) that intersect the communication interface, which reside between the detachable bezel 130 and the receiving module 120. Generally, the receiving module 120 is fixedly mounted to an interior surface of the intermediate materials.

Typically, the securing elements 150 and 160 are positioned on the detachable bezel 130 and the receiving module 120, respectively, such that, when engaged, the securing elements 150 and 160 are aligned in a mirror-image orientation. In operation, the securing elements 150 and 160 promote ease of disengagement and firmness of hold when engaged. For example, the securing elements 150 and 160 are configured as complementary rare earth magnets. Although described in one instance as magnets, the securing elements 150 and 160 may be configured as any mechanism or fastener known in the relevant field of technology that is configured to selectively mount one component to another across a section of upholstery covering a seating unit.

In an exemplary embodiment, the receiving module 120 represents an electronic backplate that faces an internal side of the intermediate materials. When the detachable bezel 130 is engaged to the receiving module 120, the receiving module 120 is configured to detect user-initiated inputs applied to the detachable bezel 130. However, when the detachable bezel 130 is disengaged from the receiving module 120, user-initiated inputs applied to the detachable bezel 130 are no longer considered as valid command signals by the receiving module 120. As illustrated in FIG. 2, a proximity switch 170 is employed by the receiving module 120 to detect whether the detachable bezel 130 is engaged thereto. In one embodiment, the proximity switch 170 represents an electrical switch (e.g., reed switch) operated by an applied magnetic field. By way of example, the electrical switch may consist of a pair of contacts on ferrous metal reeds. These contacts remain in a normally open condition, closing when a magnetic field is present. Or, the contacts may remain in a normally closed condition, opening when a magnetic field is applied. Although various different configurations of the proximity switch 170 have been described, it should be understood and appreciated that other types of suitable devices that are enabled to detect engagement and/or disengagement of one component to another may be used, and that embodiments of the present invention are not limited to the reed switch described herein. For instance, a spring-loaded, poppet-style, retractable pin may be employed on the receiving module 120 to detect that the detachable bezel 130 has been engaged thereto, where the retractable pin is physically depressed the detachable bezel 130 is selectively assembled to an exterior of the intermediate material opposed to the receiving module 120.

In operation, the proximity switch 170 may be actuated by bringing a magnet (e.g., securing elements 150) near to the proximity switch 170, thus, detecting that the detachable bezel 130 is within a predefined range. That is, the magnetic field produced from an electromagnet or a permanent magnet installed on the detachable bezel 130 will cause the contacts of the electrical switch to come together, thus, completing an electrical circuit. Upon completing the electrical circuit, the receiving module 120 is transitioned from a passive state to an active state that allows the receiving module 120 detect and relay to the activation device command signals generated at the communication interface between the receiving module 120 and the detachable bezel 130.

When the magnet field, accommodated on that detachable bezel 130, is pulled away from the proximity switch 170, the proximity switch 170 will revert to its default position. By way of example, when the proximity switch 170 is represented by a reed switch, the stiffness of the reeds causes the contacts to separate and the circuit to open, when the magnetic field is removed. Upon breaking the electrical circuit, the receiving module 120 is transitioned from the active state to the passive state that prevents the receiving module 120 from relaying to the activation device command signals generated at the communication interface between the receiving module 120 and the detachable bezel 130. In this way, the proximity switch 170 located within the receiving module 120 deactivates control of the activation device upon the detachable bezel 130 being detached and removed from range. Thus, the proximity switch 170 allows for compliance with Canadian safety regulations, in which children shall not be able to reach remotes-controls that adjust furniture.

Figure 3:
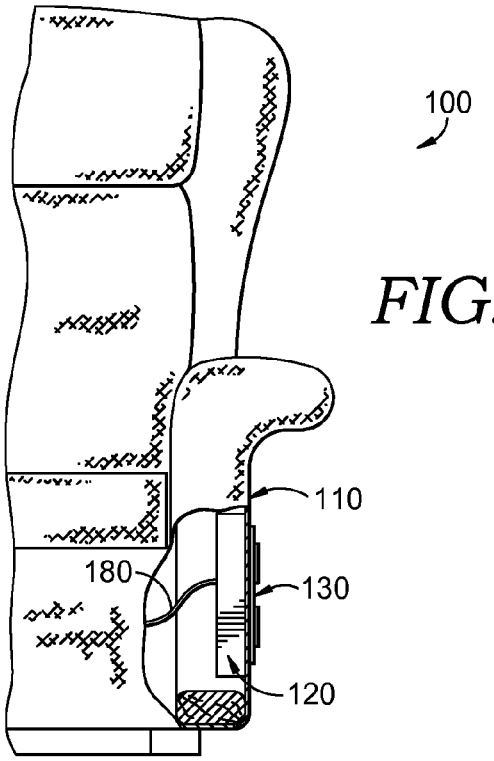
FIG. 3 is a diagrammatic partial elevation view that exposes the receiving element within a cut-away of the seating unit, where the detachable bezel is engaged to the receiving module, in accordance with an embodiment of the present invention.
Figure 4:
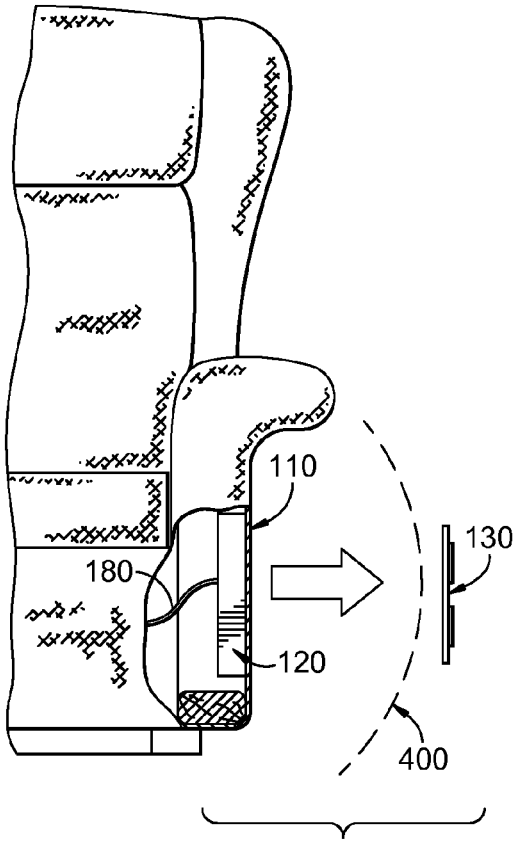
FIG. 4 is a view similar to FIG. 3, but with the detachable bezel disengaged with the receiving module, in accordance with an embodiment of the present invention.

With reference to FIGS. 3 and 4, diagrammatic partial elevation views are shown that expose the receiving module 120 within a cut-away of the seating unit 100, where the detachable bezel 130 is engaged to (FIG. 3) and disengaged from (FIG. 4) the receiving module 120, in accordance with embodiments of the present invention. When engaged, user-initiated inputs at the detachable bezel 130 generate command signals that are sensed at the receiving module 120 and conveyed to the activation device via an electronic coupling 180 (e.g., wiring). Although the portion of intermediate material 110 of the seating unit 100 intersects the communication interface that exists between the receiving module 120 and detachable bezel 130, sensors on the receiving module 120 are still equipped to detect user-initiated inputs at the detachable bezel 130. In embodiments, as indicated at reference numeral 190 of FIG. 2, the sensors may be integrated within the receiving module 120 and adapted to read command signals distributed from touch-activated controls 140 upon being manipulated by an operator. Sensors 190 are in the active state, as discussed above, when the proximity switch 170 indicates that the detachable bezel 130 is engaged with the receiving module 120.

Returning to FIGS. 3 and 4, the detachable bezel 130 may be selectively disengaged from the receiving module 120. Based on the type of proximity switch 170, disengagement may occur a differing ranges 400. In one instance, when the proximity switch 170 represents an electric reed switch, the range 400 may substantially equate to a reach of the magnetic field generated by the securing elements 150 (e.g., rare earth magnets) installed to the detachable bezel 130. In another instance, when the proximity switch 170 represents a pin, the range 400 may be reduced in size to extend just an outward projected distance of the pin. Once the detachable bezel 130 is physically moved beyond the range 400, the receiving module 120 is placed into a passive state via the proximity switch 170 (i.e., interrupting the communication interface), thus, is no longer operable to process command signals.

With reference to FIG. 4, in an exemplary embodiment, the detachable bezel 130 represents an electronic faceplate (e.g., formed of plastic) that is designed to selectively mount to the receiving module 120 such that the detachable bezel 130 faces an external side of a section of upholstery 110 covering the seating unit 100. Further, the detachable bezel 130 may include various features, such as touch-activated controls 140. In one example, these touch-activated controls 140 represent a keypad for receiving the user-initiated inputs, thereby allowing an operator to invoke automatic adjustment of the seating unit 100. In another example, the touch-activated controls 140 are housed in the detachable bezel 130 as buttons used for controlling motion furniture and adjustable bedding. In operation, the touch-activated controls 140 generate a command signal (e.g., capacitive, inductive, or infrared) that can be read through upholstery and other thin materials, such as wood and plastic. For instance, the command signal may be generated by creating a capacitive or inductive output on the detachable bezel 130 as a result of a user-initiated input at one or more of the touch-activated controls 140, which, in this instance, represent capacitive touch-buttons. When employing capacitive touch-buttons, the command signal may vary as a function of a quality and/or quantity of touch applied thereto. Further, the command signals operate in the low-voltage manner in order to decrease risk of igniting intermediate materials.

In instances, when the touch-activated controls 140 represent capacitive touch-buttons, the capacitive touch-buttons generate the command signals upon the occupant of the seating unit depressing the capacitive touch-buttons. In embodiments, the command signals represent electrical outputs generated by the set of sensors 190 when triggered by the depressed capacitive touch-buttons, respectively. That is, the touch-activated controls 140 interact with at least one of the set of sensors 190 to generate the command signal(s). In embodiments, the relative location of the command signal(s), which are detected by the receiving module 120, may determine a type of command associated with the generated command signals. Typically, the touch-activated controls 140 are arranged to align with the set of sensors 190 in a minor-image orientation when the detachable bezel 130 is assembled to the receiving module 120.

Although described in one instance as capacitive-touch buttons, the touch-activated controls 140 may be configured as any mechanism or a element known in the relevant field of technology that is configured to receive a user-initiated input and generate command signals that may be sensed across a section of upholstery covering a seating unit. For instance, the touch-activated controls 140 may employ nonconductive technologies, such as infrared, that may be implemented to generate the command signals via the communication interface with the receiving module 120. In this example, when depressed by the occupant of the seating unit, the touch-activated controls 140 generate an infrared output that is read by the set of sensors 190, respectively.

Other features that may be included on the detachable bezel 130 included the following: presentation element(s) for displaying graphics; assistive instructions (e.g., Braille, LEDs, and printed information); and auxiliary controls. In embodiments, the auxiliary controls may be user-operated to manage operation of other electronic-controlled devices. These other devices may include apparatuses attached to the seating unit (for invoking adjustment of the seating unit) or other apparatuses removed from the seating unit. For instance, command signals received at the receiving module 120 via the auxiliary controls may be relayed to one or more destination devices (e.g., stereo equipment, thermostat, lighting fixtures, and the like) that affect an environment surrounding an occupant of the seating unit.

Figure 5:
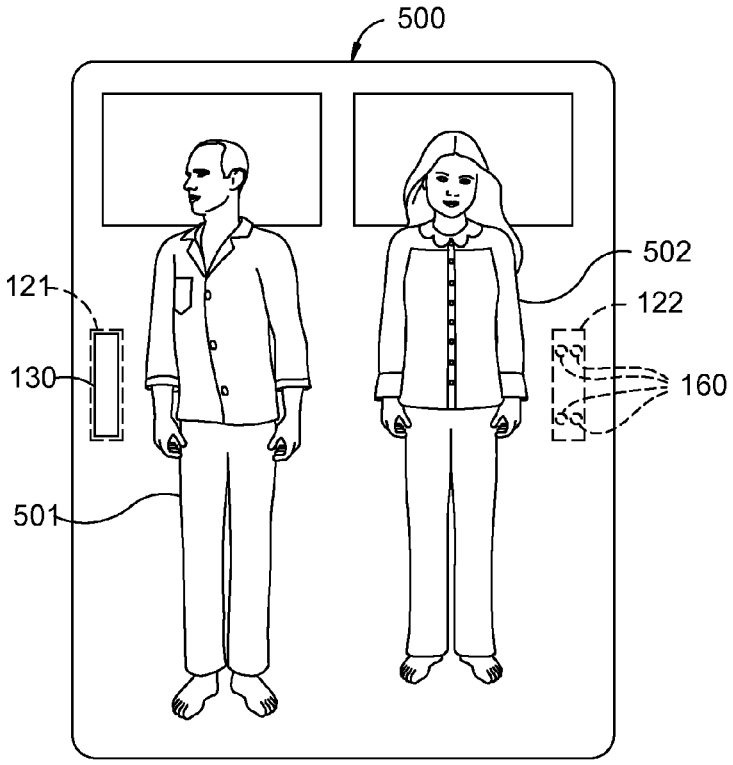
FIG. 5 is a diagrammatic landscape view of a seating unit configured as a bed that has a removable control mechanism assembled thereto, in accordance with an embodiment of the present invention.

Turning now to FIG. 5, a diagrammatic landscape view of a seating unit is shown, where the seating unit is configured as a bed 500 that has a removable control mechanism assembled thereto in accordance with an embodiment of the present invention. In this instance, the removable control mechanism includes various receiving modules 121 and 122 that accept engagement of the detachable bezel 130. Accordingly, the receiving modules 121 and 122 each accommodate a similar pattern of the securing elements 160 that are arranged complementary to the securing elements 150 of the detachable bezel 130. In this way, the detachable bezel 130 may be engaged to a mattress, a foundation, a pillow, an adjustable bed shroud, or any other bedding articles that can be reached by occupants 501 or 502 of the bed 500. Further, the receiving modules 121 and 122 may be installed to any internal surface of the mattress, the foundation, the pillow, the adjustable bed shroud, or any other bedding articles. In one embodiment, the receiving module 120, the detachable bezel 130, or both may be encased for moisture protection (protective or decorative cover). In this example illustrated in FIG. 5, the intermediate materials comprise a fitted sheet, a blanket, a mattress pad, etc.

Figure 6:
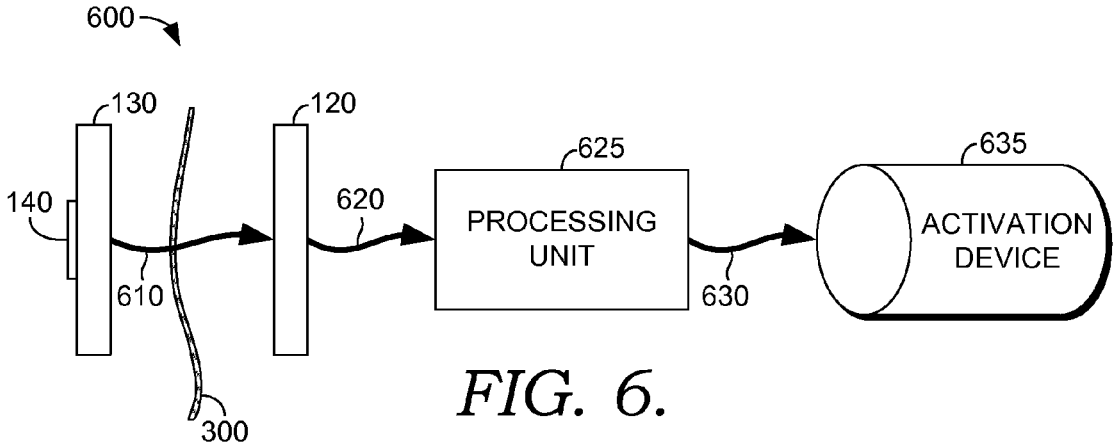
FIG. 6 is a schematic depiction of a system for operably coupling the removable control mechanism to an activation device.

Turning now to FIG. 6, a schematic depiction of a system 600 for operably coupling the removable control mechanism to an activation device 635 is shown. Initially, the system 600 includes the removable control mechanism (detachable bezel 130 and receiving module 120), a processing unit 625, and the activation device 635. As discussed above, the user-initiated input at one or more touch-activated controls 140 generate a command signal 610 that is communicated via command signals 610 across an intermediate material 300 to the receiving module 120. The receiving module 120 may process the command signals 610 and pass them directly to the activation device 635. Or, the receiving module 120 may relay the command signals 610 as an input 620 to the processing unit 625. The processing unit 625 is configured to interpret the input 620 and generate an output 630, based on predefined logic, that instructs the activation device 635 automatically adjust the seating unit.

In embodiments, the processing unit 625 may be a personal computer, desktop computer, laptop computer, consumer electronic device, handheld device (e.g., personal digital assistant), various servers, processing equipment, and the like. It should be noted, however, that the invention is not limited to implementation on such computing devices but may be implemented on any of a variety of different types of computing devices within the scope of embodiments of the present invention.

Typically, the processing unit 625 represents some form of computing unit (e.g., central processing unit, microprocessor, etc.) to support operations of the activation device 635. As utilized herein, the phrase "computing unit" generally refers to a dedicated computing device with processing power and storage memory, which supports operating software that underlies the execution of software, applications, and computer programs thereon. In one instance, the computing unit is configured with tangible hardware elements, or machines, that are integral, or operably coupled, to the processing unit 625 to enable performance of communication-related processes and other operations (e.g., interpreting the input 620 and forming an output 630). In another instance, the computing unit may encompass a processor (not shown) coupled to the computer-readable medium accommodated by the processing unit.

Generally, the computer-readable medium includes physical memory that stores, at least temporarily, a plurality of computer software components that are executable by the processor. As utilized herein, the term "processor" is not meant to be limiting and may encompass any elements of the computing unit that act in a computational capacity. In such capacity, the processor may be configured as a tangible article that processes instructions. In an exemplary embodiment, processing may involve fetching, decoding/interpreting, executing, and writing back instructions. Thus, the processing unit 625 serves as an intelligent machine that processes the input 625 in light of predefined logic in order to control the activation device 635 via the output 630. As mentioned above, the activation device 635 (e.g., linear actuator or electric motor) may comprise any device that is configured to adjust a seating unit.

Figure 7:
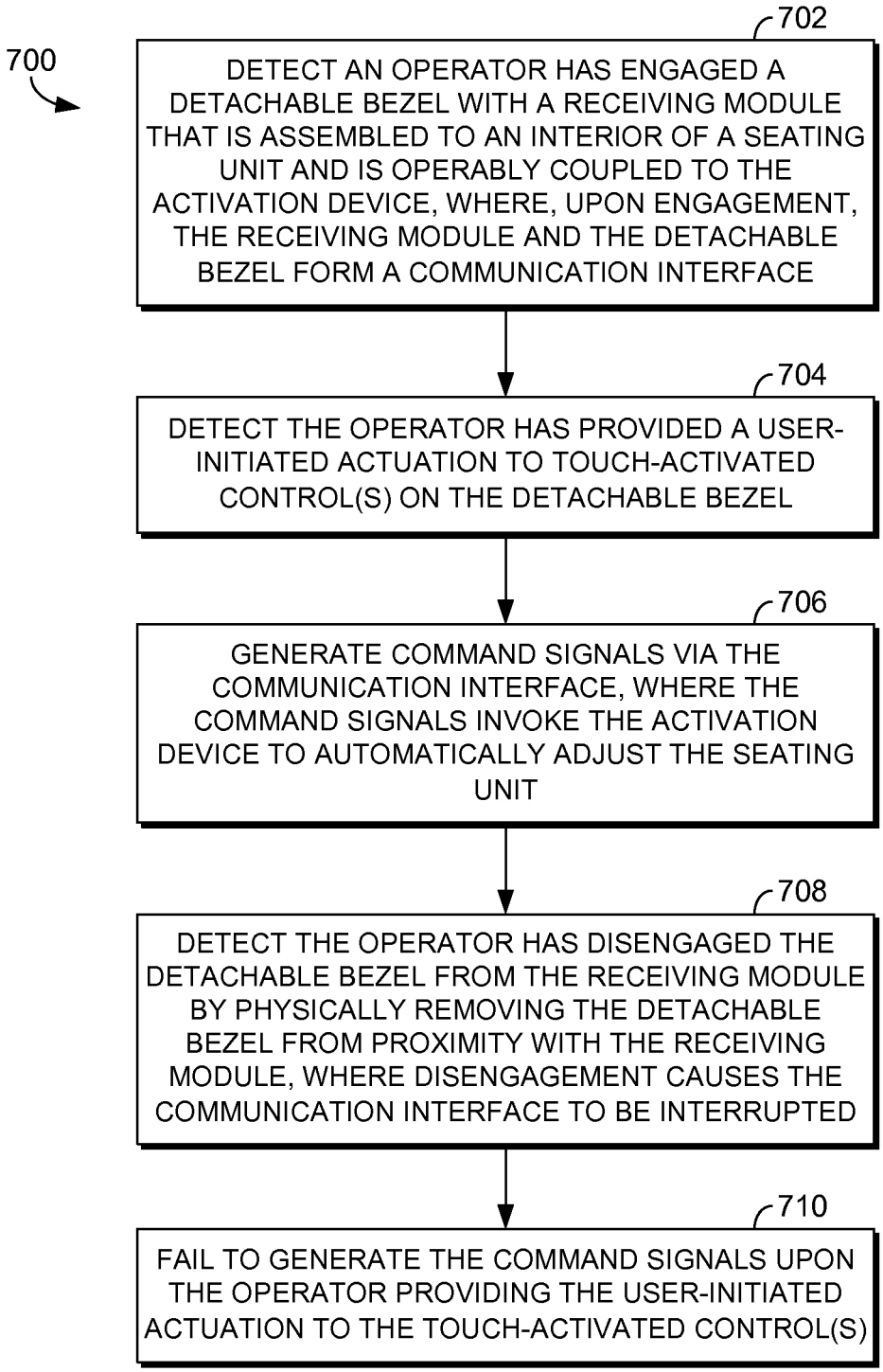
FIG. 7 is a flow diagram illustrating an overall method for enabling and disabling control of an activation device, which is configured to automatically adjust a portion of the seating unit, in accordance with an embodiment of the present invention.

Turning now to FIG. 7, a flow diagram is illustrated that shows an overall method 700 for enabling and disabling control of an activation device. As mentioned above, the activation device is configured to automatically adjust a portion of the seating unit, in accordance with an embodiment of the present invention. Initially, as indicated at block 702, the method 700 involves detecting that an operator has engaged a detachable bezel with a receiving module, which is assembled to an interior of a seating unit and is operably coupled to the activation device. Upon engagement, the receiving module and the detachable bezel form a communication interface. As indicated at block 704, a detection that the operator has provided a user-initiated actuation to touch-activated control(s) on the detachable bezel is performed. At this point, command signals are generated via the communication interface, as indicated at block 706. Typically, the command signals invoke the activation device to automatically adjust the seating unit. As indicated at block 708, a detection that the operator has disengaged the detachable bezel from the receiving module by physically removing the detachable bezel from proximity with the receiving module is performed. Generally, disengagement causes the communication interface to be interrupted. When disengaged, command signals are no longer generated upon the operator providing the user-initiated actuation to the touch-activated control(s), as indicated at block 710.

It should be understood that the construction of the removable control panel lends itself to enable the detachable bezel ended the receiving module to be easily assembled and disassembled from the remaining components of the seating unit. Specifically the nature of the receiving module, allows for use of quick-disconnect hardware to achieve rapid disconnection of components prior to shipping, or rapid connection upon receipt. Further, it should be understood and appreciated that the seating unit may be located within a traditional home or office setting, or may be employed in any other environment in which furniture may appear. Examples of such environments comprise vehicles (e.g., RVs, boats, planes, or cars).

The present invention has been described in relation to particular embodiments, which are intended in all respects to be illustrative rather than restrictive. Alternative embodiments will become apparent to those skilled in the art to which the present invention pertains without departing from its scope.

It will be seen from the foregoing that this invention is one well adapted to attain the ends and objects set forth above, and to attain other advantages, which are obvious and inherent in the device. It will be understood that certain features and subcombinations are of utility and may be employed without reference to other features and subcombinations. This is contemplated by and within the scope of the claims. It will be appreciated by persons skilled in the art that the present invention is not limited to what has been particularly shown and described hereinabove. Rather, all matter herein set forth or shown in the accompanying drawings is to be interpreted as illustrative and not limiting.

What is claimed:

1. A removable control mechanism for a seating unit, the removable control mechanism configured for controlling an activation device that causes automated adjustment of the seating unit, the removable control mechanism comprising:

a receiving module assembled to an interior of the seating unit and operably coupled to the activation device, wherein the receiving module is configured to receive command signals via a communication interface and to invoke the activation device as a function of the command signals; and a detachable bezel that resides external to the seating unit, wherein the detachable bezel includes touch-activated controls that, upon receiving user-initiated actuation, generate the command signals via the communication interface, wherein at least a portion of the communication interface is positioned between the receiving module and the detachable bezel, and wherein a first portion of the seating unit intersects the at least a portion of the communication interface, wherein one or more securing elements are associated with the receiving module and positioned interior to the seating unit such that a second portion of the seating unit covers the one or more securing elements associated with the receiving module, and wherein the one or more securing elements associated with the receiving module are configured to selectively mount the detachable bezel in proximity to the receiving module across the second portion of the seating unit.

2. The removable control mechanism of claim 1, wherein the receiving module represents an electronic backplate that faces an internal side of a section of upholstery.

3. The removable control mechanism of claim 2, wherein the section of upholstery represents at least the first portion of the seating unit that intersects the at least a portion of the communication interface.

4. The removable control mechanism of claim 1, wherein the detachable bezel represents an electronic faceplate, and wherein the touch-activated controls represent a keypad for receiving the user-initiated actuation that allows an operator to invoke automatic adjustment of the seating unit.

5. The removable control mechanism of claim 4, wherein the detachable bezel includes a presentation element for displaying graphics.

6. The removable control mechanism of claim 1, wherein the detachable bezel is configured to engage and disengage with the receiving module.

7. The removable control mechanism of claim 6, wherein disengagement between the detachable bezel and the receiving module comprises removing the detachable bezel away from the receiving module beyond a predefined range such that the communication interface is interrupted, wherein the predefined range substantially equates to a reach of a magnetic field generated by the one or more securing elements associated with the receiving module or one or more securing elements associated with the detachable bezel.

8. The removable control mechanism of claim 6, wherein engagement between the detachable bezel and the receiving module comprises selectively mounting the detachable bezel in proximity to the receiving module such that the detachable bezel faces an external side of a section of upholstery covering the seating unit.

9. The removable control mechanism of claim 8, wherein one or more securing elements are associated with the detachable bezel.

10. The removable control mechanism of claim 9, wherein the one or more securing elements associated with the receiving module and the one or more securing elements associated with the detachable bezel comprise rare earth magnets.

11. The removable control mechanism of claim 9, wherein the one or more securing elements associated with the detachable bezel and the one or more securing elements associated with the receiving module are aligned in a mirror-image orientation.

12. The removable control mechanism of claim 1, wherein the second portion of the seating unit comprises a section of upholstery covering the seating unit.

13. The removable control mechanism of claim 11, wherein the detachable bezel includes assistive instructions for informing an operator about usage of the removable control mechanism.

14. A seating unit, comprising:

a section of substrate covering a portion of the seating unit;

an activation device for causing automated adjustment of the seating unit;

a receiving module assembled to an interior of the seating unit and operably coupled to the activation device, wherein the receiving module is configured to receive command signals via a communication interface and invoke the activation device as a function of the command signals;

a detachable bezel that resides external to the seating unit, wherein the detachable bezel is adapted to receive user-initiated actuation from an occupant of the seating unit and, in reaction, to generate the command signals via the communication interface, wherein at least a portion of the communication interface is positioned between the receiving module and the detachable bezel, and wherein the section of substrate intersects the at least a portion of the communication interface;

a proximity switch for indicating whether the receiving module is engaged to or disengaged with the detachable bezel, wherein, when engaged, the communication interface allows the command signals to be transferred from the receiving module to the detachable bezel, and wherein, when disengaged, the communication interface is interrupted, wherein one or more securing elements are associated with the receiving module and positioned interior to the seating unit such that at least a portion of the section of substrate covers the one or more securing elements, and wherein the one or more securing elements are configured to selectively mount the detachable bezel in proximity to the receiving module across the at least a portion of the section of substrate.

15. The seating unit of claim 13, wherein the communication interface comprises touch-activated controls included in the detachable bezel and a set of sensors included within the receiving module, wherein, upon receiving the user-initiated actuation, at least one of the touch-activated controls interact with at least one of the set of sensors to generate the command signal.

16. The seating unit of claim 15, wherein the touch-activated controls are arranged to align with the set of sensors in a mirror-image orientation when the detachable bezel is assembled to the receiving module.

17. The seating unit of claim 15, wherein the touch-activated controls represent capacitive touch-buttons that generate the command signals upon the occupant of the seating unit depressing the capacitive touch-buttons, wherein the command signals represent electrical outputs originated by the set of sensors when triggered by the depressed capacitive touch-buttons, respectively.

18. The seating unit of claim 10, wherein the touch-activated controls, when depressed by the occupant of the seating unit, generate an infrared output that is read by the set of sensors, respectively.

19. The seating unit of claim 10, further comprising a processing unit that is configured to interpret the command signals and generate an output, based on predefined logic, that instructs the activation device automatically adjust the seating unit.

20. A process for enabling and disabling control of an activation device that is configured to automatically adjust a portion of the seating unit, the process comprising:

detecting that an operator has engaged a detachable bezel with a receiving module that is assembled to an interior of the seating unit and operably coupled to the activation device, wherein, upon engagement, the receiving module and the detachable bezel form a communication interface, wherein the detachable bezel resides external to the seating unit and includes touch-activated controls, wherein at least a portion of the communication interface is positioned between the receiving module and the detachable bezel, wherein a first portion of the seating unit intersects the at least a portion of the communication interface, wherein one or more securing elements are associated with the receiving module and positioned to the interior of the seating unit such that a second portion of the seating unit covers the one or more securing elements, and wherein the one or more securing elements are configured to selectively mount the detachable bezel in proximity to the receiving module across the second portion of the seating unit;

detecting that the operator has provided a user-initiated actuation to at least one of the touch-activated controls;

generating the command signals via the communication interface, wherein the command signals invoke the activation device to automatically adjust the seating unit;

detecting that the operator has disengaged the detachable bezel from the receiving module by physically removing the detachable bezel from proximity with the receiving module, wherein disengagement causes the communication interface to be interrupted; and failing to generate the command signals upon the operator providing the user-initiated actuation to at least one of the touch-activated controls.

* * * * *